US006833778B2

(12) United States Patent
Ohmi et al.

(10) Patent No.: US 6,833,778 B2
(45) Date of Patent: Dec. 21, 2004

(54) ELECTROMAGNETIC SWITCH AND STARTER USING THE SAME

(75) Inventors: Masanori Ohmi, Anjo (JP); Tsutomu Shiga, Nukata-gun (JP); Masami Niimi, Handa (JP); Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/795,254

(22) Filed: Mar. 9, 2004

(65) Prior Publication Data

US 2004/0178870 A1 Sep. 16, 2004

(30) Foreign Application Priority Data

Mar. 11, 2003 (JP) ..... 2003-064426

(51) Int. Cl.[7] ..... H01H 67/02

(52) U.S. Cl. ..... 335/131; 335/132; 335/185; 335/192; 335/274

(58) Field of Search ..... 335/126, 131, 335/132, 185, 187, 189, 192, 255, 270, 274

(56) References Cited

U.S. PATENT DOCUMENTS 6,236,293 B1 * 5/2001 Forster ..... 335/132
2003/0193382 A1 10/2003 Shiga et al.

* cited by examiner

*Primary Examiner*—Ramon M. Barrera
(74) *Attorney, Agent, or Firm*—Oliff & Berridge, PLC

(57) ABSTRACT

An electromagnetic switch includes a contact holding member connected to a plunger in order to hold a first movable contact. The contact holding member is disposed outside a switch case covering a periphery of an excitation coil. A return spring pushes the plunger back in the opposite direction to a fixed iron core through the contact holding member when electric power supply to the excitation coil is stopped. The return spring is disposed outside the switch case. In this structure, a spring holding portion does not need to be disposed in the fixed iron core and the plunger. Therefore, an area where the fixed iron core attracts the plunger can be increased, so that an attraction force can be increased.

8 Claims, 2 Drawing Sheets

ELECTROMAGNETIC SWITCH AND STARTER USING THE SAME

CROSS REFERENCE TO RELATED APPLICATION

This application is based on Japanese Patent Application No. 2003-64426 filed on Mar. 11, 2003, the disclosure of which is incorporated herein by reference.

BACKGROUND OF THE INVENTION

1. Field of the Invention

The present invention relates to an electromagnetic switch used for a starter to start an internal combustion engine.

2. Description of Related Art

A magnet switch is disclosed in U.S. Pat. No. 193,382 A1(corresponding to JP-A-2002-110296). This magnet switch does not include a rod, which is connected to a plunger and holds a movable contact. Instead of the rod, this magnet switch has a contact holding member for holding the movable contact. The contact holding member is disposed outside a switch case accommodating an excitation coil and includes a flange and a holder. The flange is fixed to the plunger. The holder is made of resin and is connected to the flange. The holder is electrically insulated from the movable contact and holds the movable contact.

However, the above magnet switch has a return spring which is disposed inside the excitation coil between the plunger and a fixed iron core to push the plunger in an opposite direction to the fixed iron core. Therefore, a holding portion (positioning portion) for holding the return spring needs to be provided in both the plunger and the fixed iron core. As a result, an area where the plunger and the fixed iron core oppose each other is reduced. Therefore, an attraction force when the fixed iron core attracts the plunger is reduced. Accordingly, an outer diameter of the excitation coil needs to be increased when the switch is designed based on the attraction force. This causes the switch to increase in size.

SUMMARY OF THE INVENTION

In view of the foregoing problems, it is an object of the present invention to provide an electromagnetic switch which can increase an attraction force by increasing an area where the plunger and the fixed iron core oppose each other without increasing an outer diameter of an excitation coil. Here, the electromagnetic switch is assumed to be one which has a contact holding member disposed outside a switch case. Further, the contact holding member is assumed to be connected to the plunger and hold a movable contact.

According to the present invention, an electromagnetic switch includes a return spring and a contact holding member. The return spring pushes a plunger in an opposite direction to an iron core. The contact holding member is connected to the plunger and holds a movable contact. Further, the contact holding member is disposed to move on an outside surface of a switch case, which covers at least a periphery of an excitation coil, in the axial direction of the switch case.

Further, the return spring is disposed outside the switch case and pushes the plunger back in the opposite direction to the iron core through the contact holding member when electric power supply to the excitation coil is stopped.

In this switch structure, the return spring is disposed outside the switch case. Therefore, a holding portion (stage portion) for holding the return spring does not need to be provided in the plunger and the fixed iron core. Thus, an area where the fixed iron core and the plunger oppose each other is not reduced. Compared to a structure that the return spring is disposed inside the excitation coil, an area where the fixed iron core attracts the plunger can be increased. Accordingly, an attraction force can be increased. As a result, an outer diameter of the excitation coil can be reduced when the switch is designed based on the attraction force. Therefore, the electromagnetic switch can be reduced in size.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS (First Embodiment)

Figure 1:
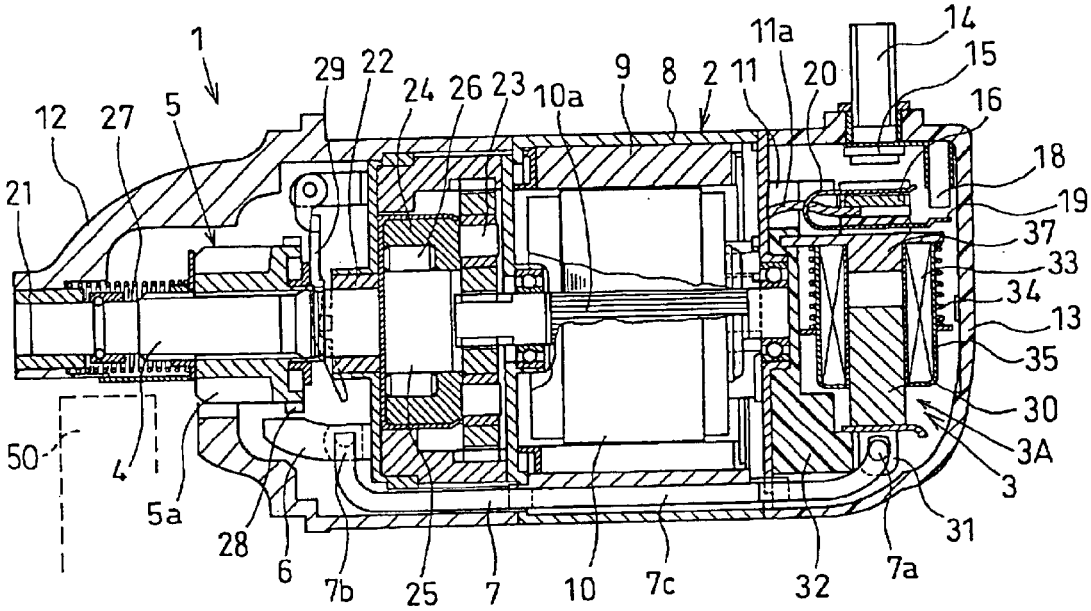
FIG. 1 is a cross-sectional view showing a starter to which an electromagnetic switch according to a first embodiment of the present invention is applied.

In the first embodiment, shown in FIG. 1, a starter 1 includes a motor 2, an electromagnetic switch 3, an output shaft 4, a pinion 5, a pinion restricting member 6, a crank bar 7 and the like. The electromagnetic switch 3 turns current of the motor 2 on or off. The output shaft 4 is driven to rotate by the motor 2, which generates torque. The pinion 5 is disposed to move on the output shaft 4. The pinion restricting member 6 restricts a rotation of the pinion 5 when the motor 2 is started. The crank bar 7 operates the pinion restricting member 6 by using an attraction force of the electromagnetic switch 3.

The motor 2 is a well-known DC motor and includes a yoke 8, fixed field poles (permanent magnets) 9, an armature 10, brushes 11 and the like. In the motor 2, battery current flows to the armature 10 thorough the brushes 11 when a motor contact (described below) is closed by the electromagnetic switch 3. As a result, torque is generated in the armature 10. The motor 2 is inserted between a housing 12 and an end cover 13. The housing 12 is attached to a front end portion of the yoke 8. The end cover 13 is attached to a rear end portion of the yoke 8.

Figure 2:
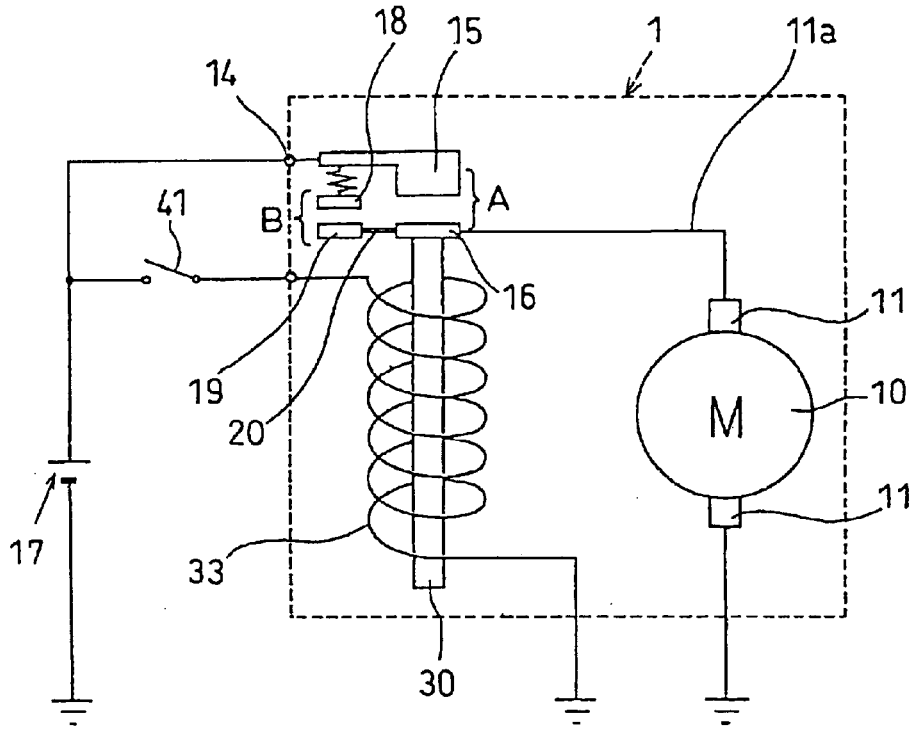
FIG. 2 is a circuit diagram showing an electric circuit of the starter.

The motor contact includes a first contact portion A and a second contact portion B as shown in FIG. 2. The first and second contact portions A, B are disposed parallel to each other in an electric circuit of the motor 2.

The first contact portion A is comprised of a first fixed contact 15 and a first movable contact 16. The first fixed contact 15 is integrated with an external terminal 14. The first movable contact 16 opposes the first fixed contact 15 and moves to and from the first fixed contact 15.

The external terminal 14 penetrates the end cover 13 and is fixed to the cover 13. A vehicle battery 17 supplies electric power to the external terminal 14 through a battery cable. The first movable contact 16 is connected to the brushes 11 at its positive pole side through a lead wire 11*a*.

The second contact portion B is comprised of a second fixed contact 18 and a second movable contact 19. The second fixed contact 18 is electrically connected to the first fixed contact 15. The second movable contact 19 opposes the second fixed contact 18 and moves to and from the first fixed contact 15.

The second fixed contact 18 is made of a material (e.g., carbon material) whose electric resistance is larger than that of the first fixed contact 15. The second movable contact 19 is electrically connected to the first movable contact 16 through a metal plate 20, for example, a copper plate with elasticity. Further, the second movable contact 19 moves together with the first movable contact 16.

As shown in FIG. 1, a distance between the second fixed contact 18 and the second movable contact 19 is smaller than a distance between the first fixed contact 15 and the first movable contact 16. Therefore, the second contact portion B is turned on earlier than the first contact portion A when the motor 2 is started. While only the second contact portion B is turned on, the battery current to the motor 2 is restricted so that a rotation speed of the armature 10 is restricted. This is because the electric resistance of the second fixed contact 18 is larger than that of the first fixed contact 15 as described above.

As shown in FIG. 1, the output shaft 4 is disposed on the same axis as that of an armature shaft 10*a* (rotation shaft) of the motor 2 on the front side of the motor 2 (on the left side in FIG. 1). The output shaft 4 is supported to rotate through a pair of bearings 21, 22. Torque of the armature 10 is transmitted to the output shaft 4 through a speed reducing device and a one-way clutch, so that the output shaft 4 rotates. The speed reducing device is a planetary gear speed reducing device which reduces a rotation speed of the armature 10 by a motion (rotation and revolution) of planetary gears 23. The one-way clutch is a well-known roller clutch which interrupts torque through rollers 26 disposed between an outer race 24 and an inner race 25.

The pinion 5 has an inner helical spline formed on its inner surface. The output shaft 4 has an outer helical spline formed on its periphery. The pinion 5 is disposed on the output shaft 4 so that the inner helical spline meshes with the outer helical spline. A pinion spring 27 normally pushes the pinion 5 in the opposite direction (in the right direction in FIG. 1) to a ring gear 50 of an engine (not shown).

The pinion 5 has a pinion gear 5*a* and a large diameter portion 28. The pinion gear 5*a* meshes with the ring gear 50 when the engine is started. The large diameter portion 28 is provided on the right side of the pinion gear 5*a* in FIG. 1, that is, on the opposite side to the ring gear 50. Multiple recesses are continuously provided on an outer diameter portion of the large diameter portion 28 in the circumferential direction.

A reverse restricting ring 29 is provided on the rear side of the pinion 5. The reverse restricting ring 29 and the pinion restricting member 6 prevent the pinion 5 from returning after the pinion gear 5*a* meshes with the ring gear 50.

The pinion restricting member 6 is disposed radially outside the large diameter portion 28 to cross the rotating direction of the pinion 5. When the motor 2 is started, the pinion restricting member 6 meshes with the recesses of the large diameter portion 28 in order to restrict the rotation of the pinion 5.

The crank bar 7 is made of a metal round bar member. The metal round bar member is bent on both ends at a predetermined angle to be a crank shape. Specifically, the crank bar 7 is comprised of a transmission portion 7*a*, an operation portion 7*b* and a bar portion 7*c*. The transmission portion 7*a* is provided on one end of the metal round bar member. The operation portion 7*b* is provided on the other end of the metal round bar member. The bar portion 7*c* connects the transmission portion 7*a* and the operation portion 7*b*.

A head portion of the transmission portion 7*a* meshes with a hook portion 31 fixed on a plunger 30 of the electromagnetic switch 3, so that an attraction force of the electromagnetic switch 3 is transmitted to the bar portion 7*c*.

The bar portion 7*c* is disposed substantially parallel to the armature shaft 10*a* to pass between the fixed field poles 9 which are disposed next to each other in the circumferential direction inside the yoke 8. The bar portion 7*c* is supported to move circularly by a pair of bearings (not shown).

The pinion restricting member 6 is attached to the operation portion 7*b*. When the attraction force of the electromagnetic switch 3 is transmitted from the transmission portion 7*a* to the bar portion 7*c*, the operation portion 7*b* moves circularly together with the bar portion 7*c*. Thus, the pinion restricting member 6 is pushed upward in FIG. 1.

In the starter 1 as described above, the pinion 5 is moved to mesh with the ring gear 50 by the act of the helical spline. That is, the pinion 5 dose not need to be pushed in axial direction by the attraction force of the electromagnetic switch 3. Accordingly, the electromagnetic switch 3 can be reduced in size because the large attraction force is not required.

Figure 3:
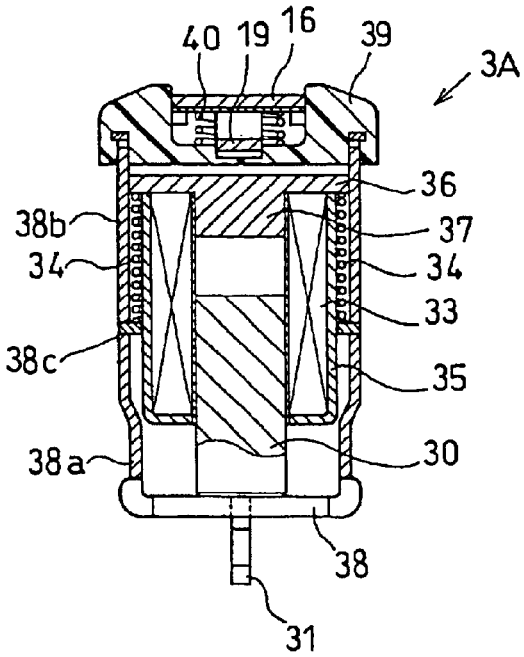
FIG. 3 is a cross-sectional view showing the electromagnetic switch according to the first embodiment.

According to this embodiment, as shown in FIGS. 1 and 3, the electromagnetic switch 3 has an electromagnetic unit 3A. The electromagnetic unit 3A drives the first and second movable contacts 16, 19 which oppose the first and second fixed contacts 15, 18.

The electromagnetic unit 3A is disposed in the rear portion of the starter 1, that is, on the rear side of the motor 2. The electromagnetic unit 3A is fixed on a pedestal 32 made of resin by a band (not shown) such as a plate spring and is covered by the end cover 13.

The electromagnetic unit 3A, includes an excitation coil 33, a fixed magnetic path (described below), the plunger 30, a contact holding member (described below) and a return spring 34 and the like. The excitation coil 33 is supplied with electric power and generates magnetic flux. The fixed magnetic path is provided so that the magnetic flux runs around the excitation coil 33. The plunger 30 is inserted inside an inner diameter portion of the excitation coil 33 through a cylindrical sleeve (not shown). The contact holding member is connected to the plunger 30 and holds the first movable contact 16. The return spring 34 pushes the plunger 30 downward in FIG. 3.

The fixed magnetic path is comprised of a switch case 35, a plate portion 36 and a fixed iron core 37. The switch case 35 accommodates the excitation coil 33 inside. The plate portion 36 covers an opening of the switch case 35. The fixed iron core 37 is integrated with the plate portion 36. However, it is possible that the fixed iron core 37 is provided separately from the plate portion 36. The fixed iron core 37 is disposed within the inner diameter portion of the excitation coil 33 at one end of the excitation coil 33.

The plunger 30 is disposed to have an air gap between the plunger 30 and the fixed iron core 37. The plunger 30 and the fixed magnetic path form a magnetic circuit through the air gap. The hook portion 31 is fixed on an end face of the plunger 30 on the opposite side to the fixed iron core 37 by press fitting or the like.

The contact holding member is comprised of a flange portion 38 and a holder portion 39. The flange portion 38 and the hook portion 31 are fixed on the end face of the plunger 30. The holder portion 39 is held by the flange portion 38.

The flange portion 38 is formed by bending a metal plate with a constant width to form an approximate U-shape. The flange portion 38 has a pair of arm portions disposed on both side faces of the switch case 35 along the axis direction, that is, the vertical direction in FIG. 3. The pair of arm portions has a first arm portion 38*a* and a second arm portion 38*b*. The first and second arm portions 38*a*, 38*b* have different width.

The first arm portion 38*a* is a portion which is bent upward in FIG. 3 from both ends of a fixed portion fixed on the end face of the plunger 30. Width of the first arm portion 38*a* is set to be substantially equal to (slightly larger than) an outer diameter of the switch case 35. The first arm portion 38*a* slides in contact with the outer peripheral surface of the switch case 35 as a guide surface when the plunger 30 reciprocates inside the inner diameter portion of the excitation coil 33.

The second arm portion 38*b* is a portion which extends upward from the first arm portion 38*a* and connects with the holder portion 39. Width of the second arm portion 38*b* is set to be larger than that of the first arm portion 38*a*.

The holder portion 39 is made of, for example, resin with electric insulation properties. As shown in FIG. 3, the holder portion 39 is disposed above the plate portion 36 to mesh with the top end of the second arm portion 38*b*. The holder portion 39 and a contact pressure providing spring 40 hold the first movable contact 16. The contact pressure providing spring 40 pushes the first movable contact 16 upward in FIG. 3. When the first contact portion A is turned on, the contact pressure providing spring 40 provides the first movable contact 16 with a contact pressure.

The return spring 34 pushes the plunger 30 back to its original position through the contact holding member when electric power supply to the excitation coil 33 is stopped. Specifically, the return spring 34 is inserted between the switch case 35 and the second arm portion 38*b*. The top end of the return spring 34 is held by the plate portion 36 which protrudes outward in the diameter direction of the switch case 35. A bottom end of the return spring 34 is held by a spring holding portion 38*c* which is provided in the second arm portion 38*b*. The inner diameter of the return spring 34 is restricted to the outer peripheral surface of the switch case 35. The outer diameter of the return spring 34 is restricted to the second arm portion 38*b*.

As described above, in the electromagnetic switch 3, the contact holding member and the return spring 34 are disposed outside the switch case 35. Therefore, it is required to prevent a foreign matter from entering a gap among and the contact holding member, the return spring 34 and the switch case 35. In the first embodiment, the electromagnetic switch 3 is surrounded by the end cover 13 of the starter 1. That is, a special cover for the electromagnetic switch 3 is not required. Therefore, the electromagnetic switch 3 does not increase in size.

In the starter 1, current flows in the excitation coil 33 of the electromagnetic switch 3 from the vehicle battery 17 when an ignition switch 41 in FIG. 2 is turned on. Therefore, magnetic flux is generated in the magnetic circuit and the attraction force acts between the fixed iron core 37 and the plunger 30. As a result, the plunger 30 is attracted toward the fixed iron core 37 and moves upward in FIG. 1 while it bends the return spring 34. This causes the crank bar 7 to move circularly. Accordingly, the pinion restricting member 6 moves upward in FIG. 1 and meshes with the recesses of the large diameter portion 28. Thus, the rotation of the pinion 5 is restricted.

According to the above movement of the plunger 30, the second contact portion B is turned on. That is, the second movable contact 19 contacts the second fixed contact 18. As a result, the battery current is restricted and flows in the armature 10. Thus, the armature 10 rotates at a low speed.

The rotation of the armature 10 is reduced by the speed reducing device and is transmitted to the output shaft 4 thorough the one-way clutch. Accordingly, the output shaft 4 rotates and the pinion 5, whose rotation is restricted by the pinion restricting member 6, moves on the output shaft 4 by action of the helical spline.

When the pinion gear 5*a* meshes with the ring gear 50, the pinion restricting member 6 comes off the recesses of the large diameter portion 28 and moves to the back of the reverse restricting ring 29. Thus, the rotation restriction of the pinion 5 is released and reversing of the pinion 5 is prevented.

Thereafter, the plunger 30 further moves and the first contact portion A is turned on. That is, the first movable contact 16 contacts the first fixed contact 15. As a result, the second contact portion B is short-circuited and large current flows in the armature 10. Therefore, the armature 10 rotates at a high speed and torque of the armature 10 is transmitted to the ring gear 50 from the pinion gear 5*a*. Thus, cranking of the engine is started.

When the ignition switch 41 is turned off after the engine is started, current flowing in the excitation coil 33 of the electromagnetic switch 3 is cut off and the magnetic flux disappears Therefore, the plunger 30 is pushed back to its original position by reaction force of the return spring 34. According to this movement of the plunger 30, the crank bar 7 moves circularly in the opposite position to that when the engine is started. As a result, the pinion restricting member 6 gets out of the back of the reverse restricting ring 29 and the reverse restriction of the pinion 5 is released. Thus, the pinion 5 reverses on the output shaft 4 based on the reaction force of the pinion spring 27 and the reversing force of the ring gear 50. Accordingly, the pinion 5 returns to the static position shown in FIG. 1.

In the electromagnetic switch 3 according to the first embodiment, the return spring 34 is disposed outside the switch case 35. Therefore, it is not required that a spring holding portion (stage portion) is provided in the fixed iron core 37 and the plunger 30. Thus, an area where the fixed iron core 37 and the plunger 30 oppose each other is not reduced. Accordingly, an area where the fixed iron core 37 attracts the plunger 30 can be increased compared to a structure that the return spring 34 is disposed inside the excitation coil 33. As a result, the attraction force can be increased. Furthermore, the outer diameter of the excitation coil 33 can be reduced compared to the above structure when the switch is designed based on the attraction force. Therefore, the electromagnetic switch 3 can be reduced in size.

Further, the return spring 34 is disposed between the switch case 35 and the second arm portion 38*b*. Therefore, the inner diameter of the return spring 34 is restricted to the switch case 35 and the outer diameter of the return spring 34 is restricted to the second arm portion 38*b*. As a result, a looseness of the return spring 34 can be prevented. In this case, an additional part is not required in order to restrict the inner and outer diameters of the return spring 34. Therefore, the number of parts does not increase. Accordingly, the return spring 34 can be assembled easily.

Furthermore, the electromagnetic switch 3 according to the first embodiment does not have a rod penetrating the plunger 30. Therefore, a gap for sliding the rod is not required. Accordingly, a looseness can be reduced and a stable operation can be achieved.

(Second Embodiment)

Figure 4:
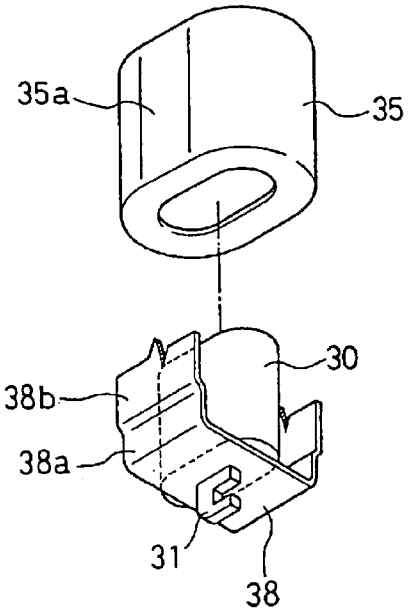
FIG. 4 is a perspective view showing a switch case and a plunger according to a second embodiment of the present invention.

In an electromagnetic switch 3 according to the second embodiment shown in FIG. 4, across sectional shape of the excitation coil 33, the fixed magnetic path (the switch case 35, the plate portion 36 and the fixed iron core 37) and the plunger 30 is substantially elliptic.

Further, a plane portion 35*a* is formed on the switch case 35. The plane portion 35*a* is substantially parallel to the long diameter direction of the switch case 35 surrounding the periphery of the excitation coil 33.

In the flange portion 38 fixed to the plunger 30, a pair of arm portions (the first and second arm portions 38*a*, 38*b*) is provided on both sides in the short diameter direction of the switch case 35. The first arm portion 38*a* moves on the plane portion 35*a* as a guide surface in the axial direction of the switch case 35. Further, the return spring 34 is also substantially ellipse-shaped in order to fit the outline of the switch case 35. Similar to the first embodiment, the return spring 34 is disposed outside the switch case 35, that is, between the switch case 35 and the second arm portion 38*b*.

The second embodiment can also increase an area where the fixed iron core 37 attracts the plunger 30. Therefore, the attraction force can be increased. Further, the looseness of the return spring 34 can be prevented because the return spring 34 is disposed between the switch case 35 and the flange portion 38 (the second arm portion 38*b*).

(Other Embodiment)

In the starter 1 according to the first embodiment, the first and second contact portions A, Bare provided in the electric circuit of the motor 2. Thus, the motor 2 is started through two stages. However, it is also possible that only one contact portion is provided and the motor 2 is started at one stage.

What is claimed is:

1. An electromagnetic device, comprising:

a fixed contact and a movable contact opposing each other for turning on and off electric power supply;

an excitation coil which generates magnetic flux by being supplied with electric power;

a switch case which covers at least a periphery of the excitation coil;

a fixed iron core which is disposed inside the excitation coil in one end portion of the excitation coil;

a plunger which is inserted inside the excitation coil to oppose the fixed iron core, the plunger being movable toward the fixed iron core when electric power is supplied to the excitation coil;

a contact holding member which moves on an outside surface of the switch case in the axial direction, the contact holding member being connected to the plunger to hold the movable contact; and a return spring which is disposed outside the switch case, the return spring pushing the plunger back in an opposite direction to the fixed iron core through the contact holding member when electric power supply to the excitation coil is stopped.

2. The electromagnetic device according to claim 1, wherein the return spring is disposed between the switch case and the contact holding member.

3. The electromagnetic device according to claim 1, further comprising:

a motor which generates torque;

an output shaft which is driven to rotate by the motor;

a pinion which meshes with the output shaft by a helical spline, the pinion moving in an opposite direction to the motor by an act of the helical spline in order to start the engine;

a pinion restricting member which meshes with the pinion to restrict a rotation of the pinion; and a transmitting member which meshes with the plunger mounted inside the excitation coil (33) to transmit a motion of the plunger to the pinion restricting member.

4. The electromagnetic device according to claim 3, wherein at least the switch case, the contact holding member and the return spring are covered by an end cover.

5. The electromagnetic device according to claim 1, wherein the contact holding member includes:

a holder portion which holds the movable contact; and a flange portion including:

a first arm portion which slides in contact with the outside surface of the switch case; and a second arm portion which accommodates the return spring and connects the holder portion, the second arm portion having a width larger than a width of the first arm portion.

6. The electromagnetic device according to claim 1, wherein the excitation coil, the switch case, the fixed iron core and the plunger have a substantially elliptic cross section.

7. An electromagnetic device, comprising:

a first fixed contact;

a second fixed contact which is connected to the first fixed contact, the second fixed contact having an electric resistance larger than an electric resistance of the first fixed contact;

a first movable contact which opposes the first fixed contact for turning on and off electric power supply;

a second movable contact which opposes the second fixed contact for turning on and off electric power supply, said second movable contact being disposed so that a distance between the second fixed contact and the second movable contact is smaller than a distance between the first fixed contact and the first movable contact;

a metal plate which has elasticity and electrically connects the first movable contact and the second movable contact;

an excitation coil which generates magnetic flux by being supplied with electric power;

a switch case which covers at least a periphery of the excitation coil;

a fixed iron core which is disposed inside the excitation coil in one end portion of the excitation coil;

a plunger which is inserted inside the excitation coil to oppose the fixed iron core, the plunger being movable toward the fixed iron core when electric power is supplied to the excitation coil;

a contact holding member which moves on an outside surface of the switch case in the axial direction, the contact holding member being connected to the plunger to hold the first movable contact and the second movable contact; and a return spring which is disposed outside the switch case, the return spring pushing the plunger back in an opposite direction to the fixed iron core through the contact holding member when electric power supply to the excitation coil is stopped.

8. The electromagnetic device according to claim 7, further comprising:

a housing;

an end cover which covers at least the switch case, the contact holding member and the return spring;

a motor which generates torque, the motor being disposed between the housing and the end cover;

an output shaft which is driven to rotate by the motor, the output shaft being disposed inside the housing;

a pinion which meshes with the output shaft by a helical spline and moves in an opposite direction to the motor by an act of the helical spline in order to start the engine, the pinion being disposed inside the housing;

a pinion restricting member which meshes with the pinion to restrict a rotation of the pinion, the pinion restricting member being disposed inside the housing; and a transmitting member which meshes with the plunger to transmit a motion of the plunger to the pinion restricting member, the transmitting member being disposed inside the housing.

* * * * *